United States Patent [19]

Craig

[11] Patent Number: 5,011,052

[45] Date of Patent: Apr. 30, 1991

[54] FOLDING DEVICE FOR APPAREL

[76] Inventor: Jason S. Craig, 413 Bonnie La., Lansdale, Pa. 19446

[21] Appl. No.: 420,306

[22] Filed: Oct. 12, 1989

[51] Int. Cl.[5] ..... A41M 33/00

[52] U.S. Cl. ..... 223/37; 223/38

[58] Field of Search ..... 223/37, 38; 493/405, 493/418, 451

[56] References Cited

U.S. PATENT DOCUMENTS

| | | | |
|---|---|---|---|
| 1,657,551 | 1/1928 | Schremp | 223/37 |
| 1,873,954 | 8/1932 | Cooper | 223/37 |
| 1,938,921 | 12/1933 | Meyer | 223/84 |
| 2,418,755 | 4/1947 | Campbell | 223/37 |
| 4,391,394 | 7/1983 | Hoffmann | 223/37 |
| 4,648,861 | 3/1987 | Pierce | 493/418 |
| 4,727,920 | 3/1988 | Siegler | 493/405 |
| 4,777,994 | 10/1988 | Nederveld | 493/405 |

FOREIGN PATENT DOCUMENTS

| | | | |
|---|---|---|---|
| 1076507 | 10/1982 | U.S.S.R. | 223/37 |

*Primary Examiner*—W. C. Reynolds
*Assistant Examiner*—Bibhu Mohanty
*Attorney, Agent, or Firm*—Joseph W. Molasky & Assocs.

[57] ABSTRACT

A device for facilitating the folding of apparel such as shirts or sweaters and the like. This device consists essentially of a flat base having a plurality of creases that allow the operator to manipulate the shirt or sweater in vertical and horizontal stages so as to achieve complete and proper folding in a uniform and attractive manner. The device has universal appeal since it may be used both at home and in the commercial trade.

8 Claims, 5 Drawing Sheets

FIG. 4
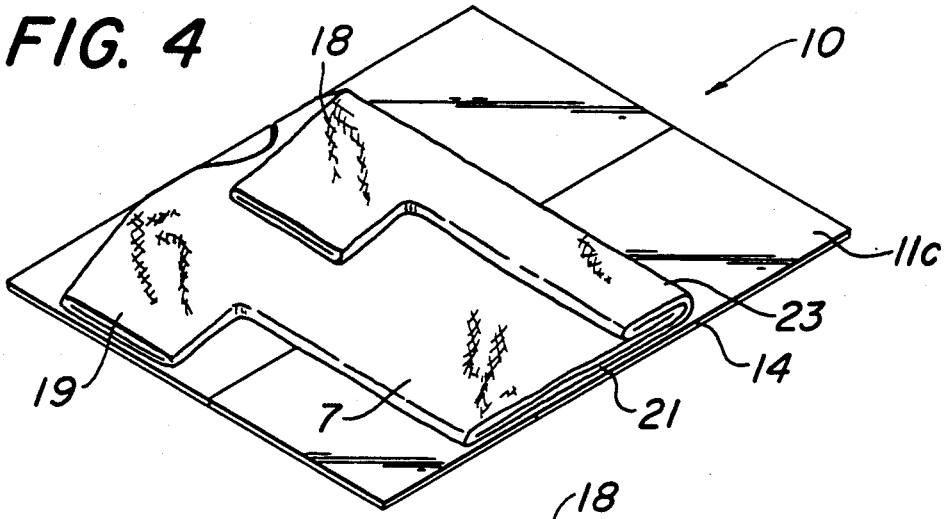
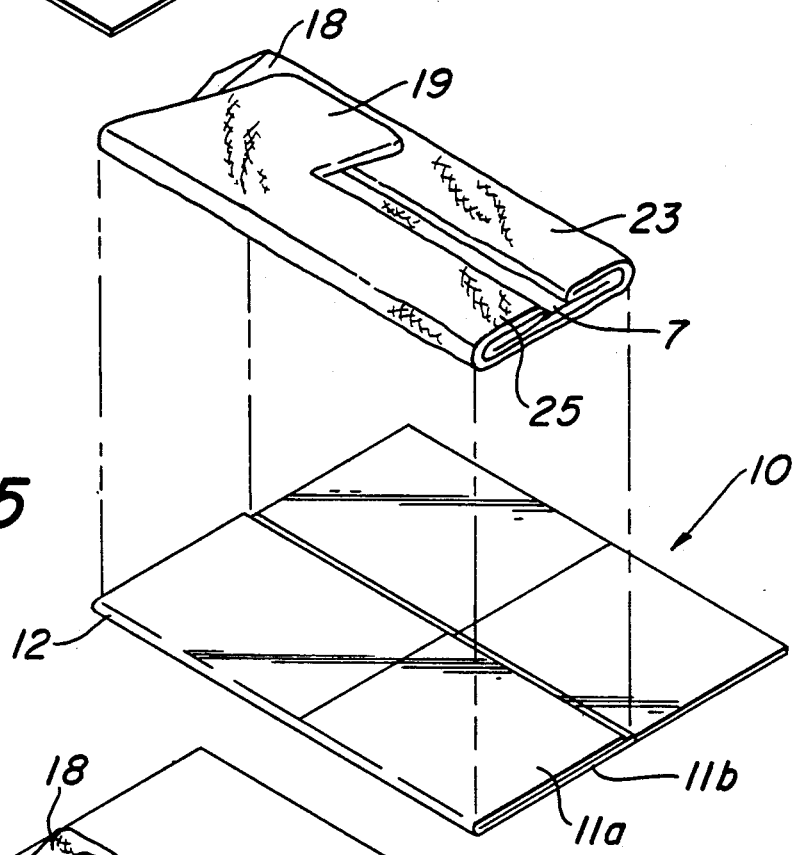
FIG. 5
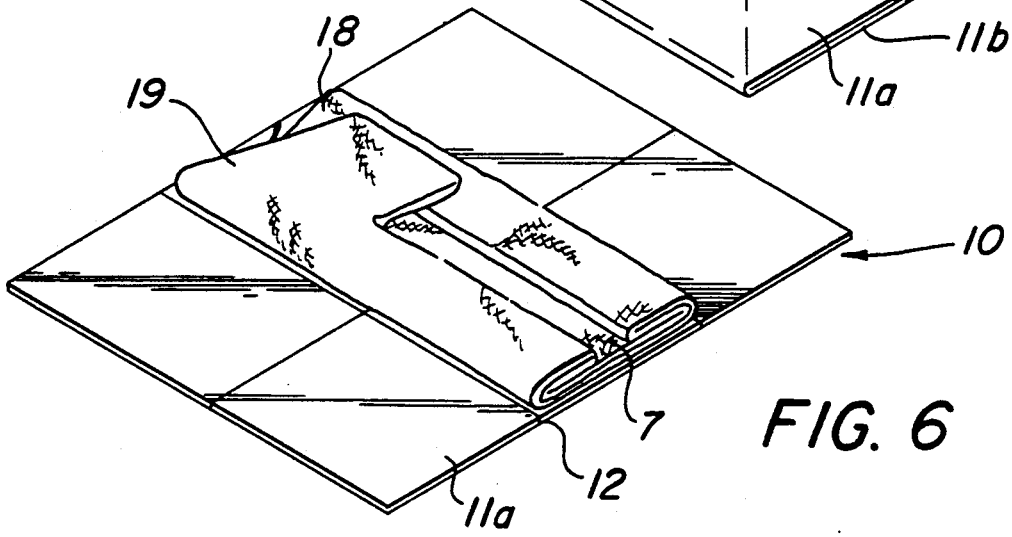
FIG. 6

FIG. 10
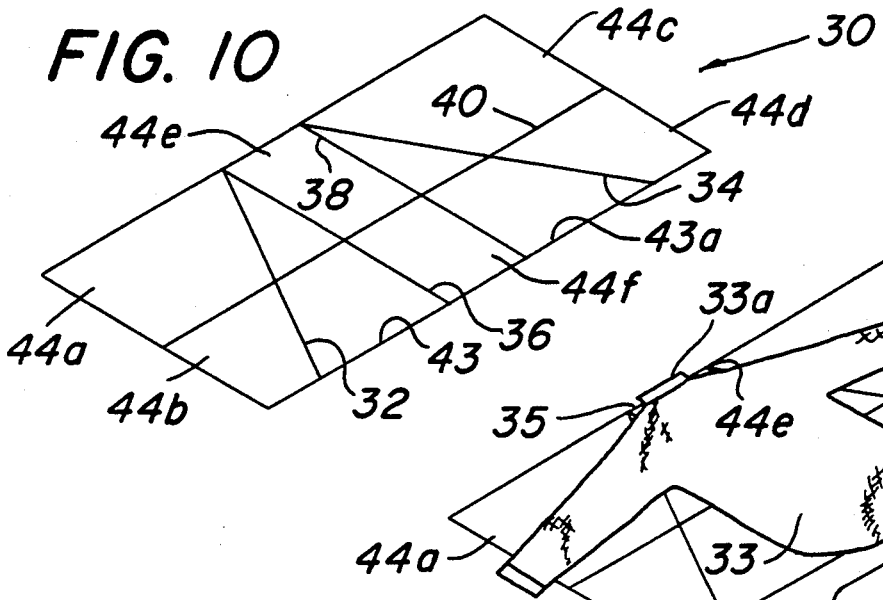
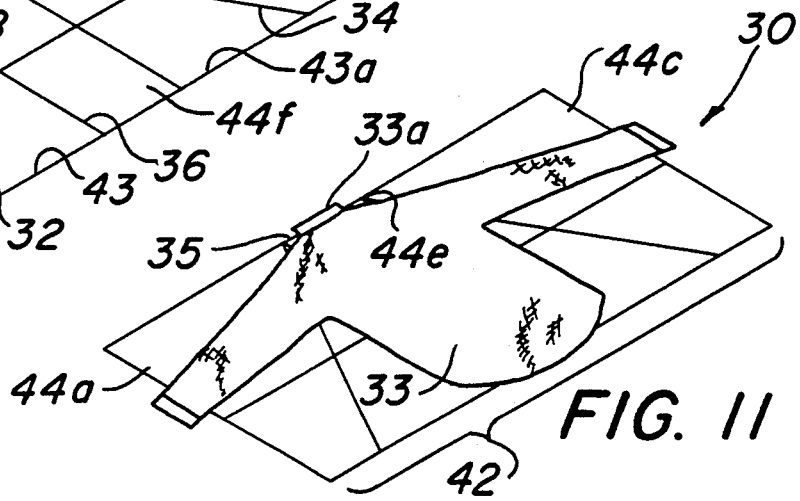
FIG. 11
FIG. 12
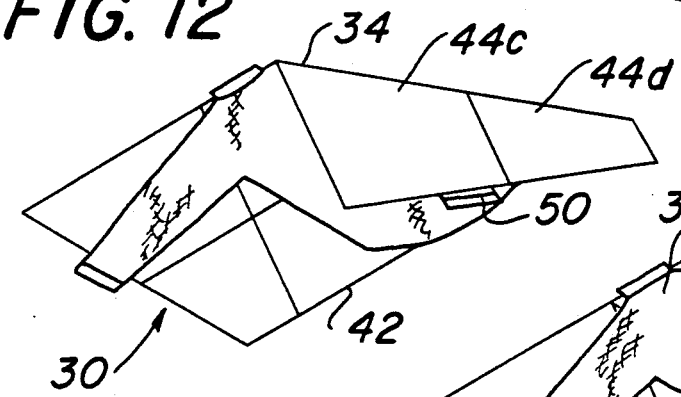
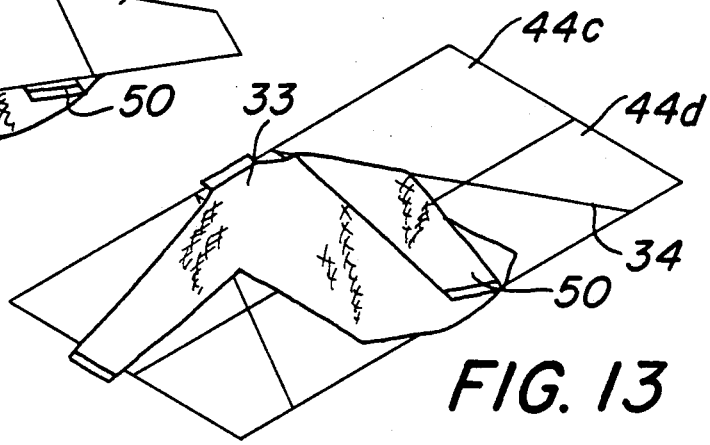
FIG. 13
FIG. 14
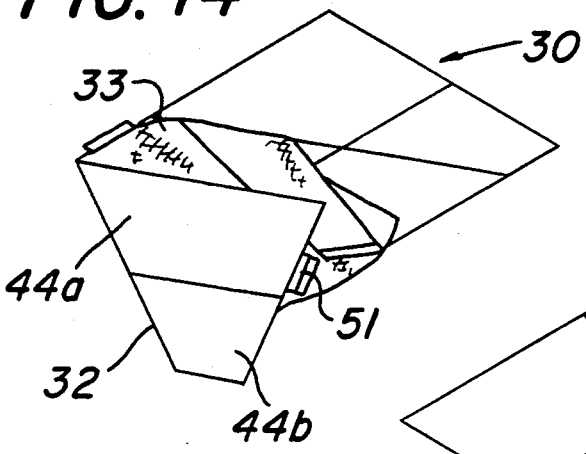
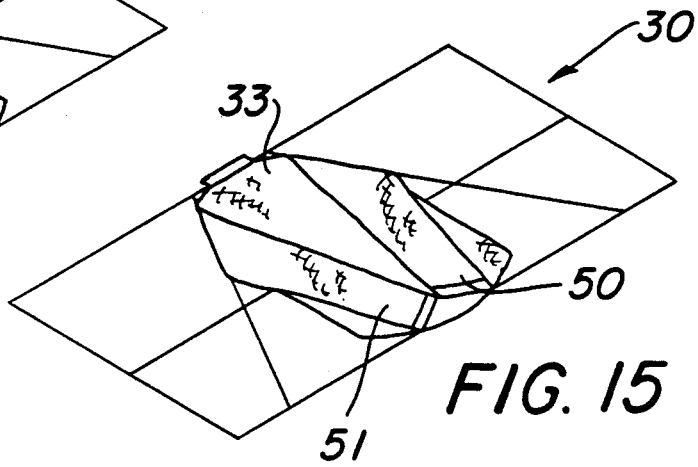
FIG. 15

FIG. 16
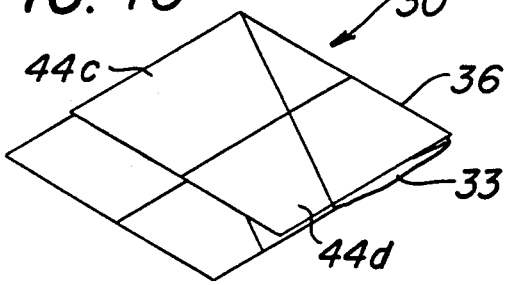
FIG. 17
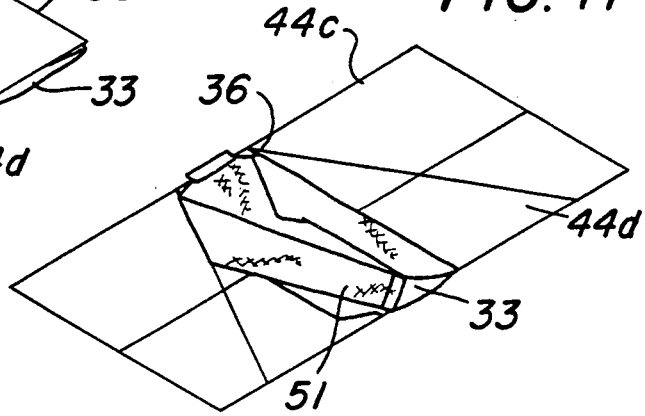
FIG. 18
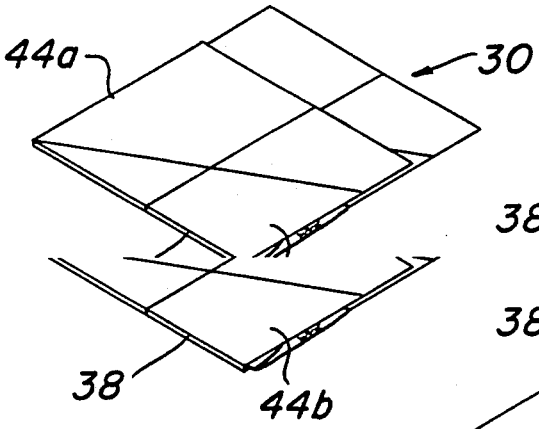
FIG. 19
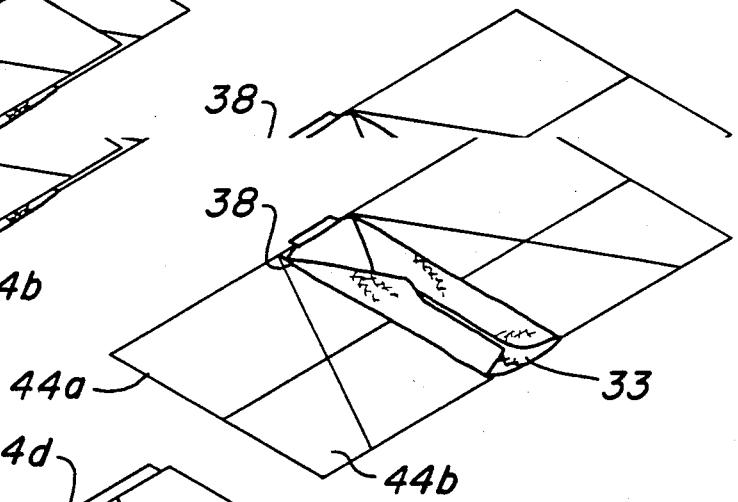
FIG. 20
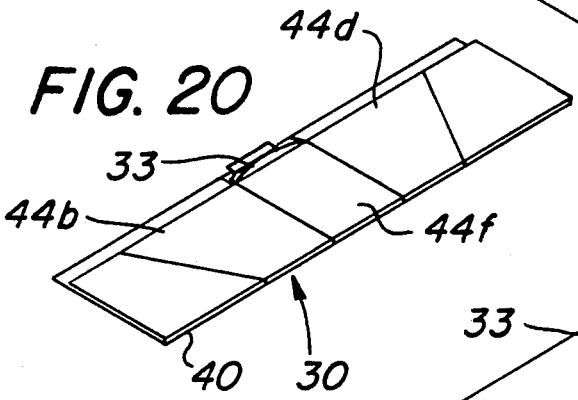
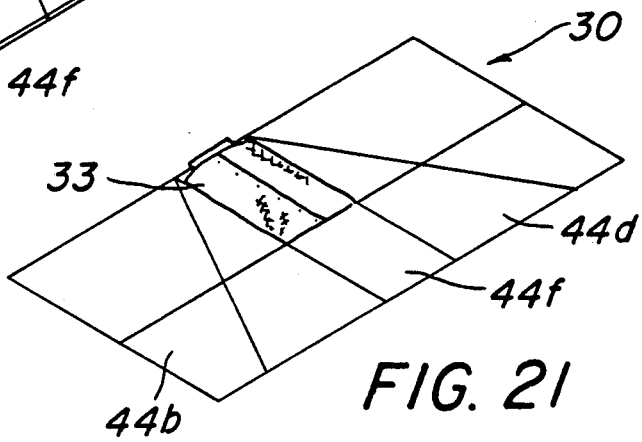
FIG. 21
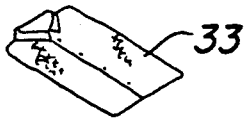
FIG. 22

FOLDING DEVICE FOR APPAREL

BACKGROUND OF THE INVENTION

This invention pertains to a device for facilitating the folding of T-shirts, dress shirts and sweaters or the like.

The volume of shirts and sweaters handled by commercial launderers and retailers requires that the folding of these goods be accomplished with relative ease and a high degree of efficiency.

Moreover, uniformity of appearance is also necessary in order that the product may be attractively displayed and packaged.

However, in the shirt apparel industry folding is conventionally done in a manual manner, and uniformity of appearance and ease of operation are not easily achieved.

The present invention is designed to assist retailers and the laundry industry in achieving these goals.

Simplicity and economy are essential attributes for any folding device because the cleaning industry operates on a volume basis with relatively low capital investment and low profit margins. Hence, expensive and complicated folding machinery does not satisfy the industry's need nor does it provide a solution to the problems faced by low margin operators. The mechanism disclosed herein is straight-forward in design and inexpensive to produce and, therefore, it meets the needs of any enterprise which may be engaged in the folding of shirts and sweaters.

Although the above discussion has been directed to the equipment needs of commercial establishments, this invention also satisfies the needs of any individual for whom the folding of apparel is a tedious or bothersome task particularly in large households where shirts and sweaters are in abundance. Moreover, the operation of this device can be taught without difficulty and it can be embellished with writing or designs so as to make its use more attractive to children.

The folding mechanism of the invention also satisfies a need for those who usually do not participate in homemaking chores.

SUMMARY OF THE INVENTION

This invention comprises a multi-creased device that allows an operator to uniformly manipulate shirts and sweaters in a series of steps for folding purposes. Two versions of the device are disclosed where one is utilized for folding T-shirts and short-sleeve sweaters and the other for folding dress shirts and long-sleeve sweaters.

The former is a three step folding device where the shirt width dimensions are reduced in two of the steps and the height dimension is reduced in the third step.

The latter device, that is, the apparatus used for folding dress shirts and long sleeve sweaters, involves a five step operation, two of which are needed to fold the sleeves inwardly, two are to reduce the width dimension and one step to reduce the height dimension.

The device finds particular application in large commercial operations where uniformity is required for packaging purposes. However, the device is equally useful for home use where there are a large number of shirt wearing members and the folding of such apparel would otherwise not occur.

It is therefore an object of this invention to provide a new and improved device for the manual folding of shirts.

It is another object of this invention to furnish a new shirt folding device that is characterized by economy of design and ease of operation.

BRIEF DESCRIPTION OF THE DRAWINGS

FIG. 4 depicts the state of the T-shirt after the first step has been completed and the folding device has been returned to its original state.

FIG. 5 represents the second step in the T-shirt folding method.

FIG. 6 shows the state of the T-shirt after the second step has been completed and the folding device has been returned to its original state.

FIG. 10 presents another embodiment of the invention where a shirt folding device for a dress shirt is depicted.

FIG. 11 illustrates the relationship of the folding device with respect to a dress shirt that is ready for folding.

FIG. 12 illustrates a first step in the dress shirt folding system of the invention.

FIG. 13 depicts the state of the dress shirt after the first step has been completed and the folding device has been returned to its original state.

FIG. 14 shows the second step in the dress folding method.

FIG. 15 represents the state of the dress shirt after the second step has been completed and the folding device has been returned to its original state.

FIG. 16 illustrates the third step in the dress shirt folding system.

FIG. 17 represents the state of the dress shirt after the third step has been completed and the folding device has been returned to its original state.

FIG. 18 shows the fourth step in the dress shirt folding method.

FIG. 19 illustrates the state of the dress shirt after the fourth step has been completed and the folding device has been returned to its original state.

FIG. 20 represents the fifth step in the dress shirt folding system.

FIG. 21 shows the state of the dress shirt after the fifth step has been completed and the folding device has been returned to its original state.

FIG. 22 shows the completely folded dress shirt.

DESCRIPTION OF THE PREFERRED EMBODIMENT

Figure 1:
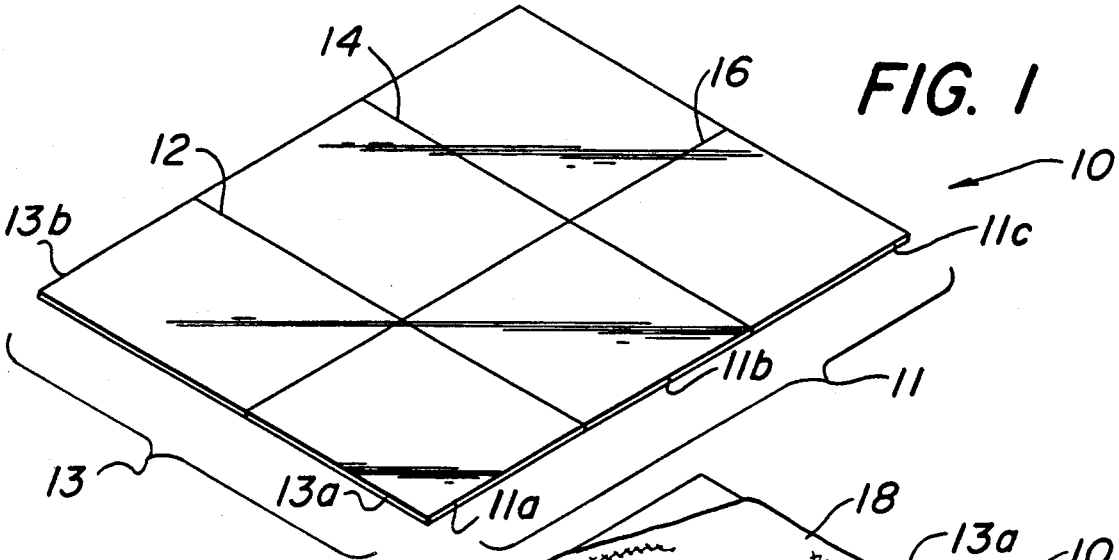
FIG. 1 depicts an embodiment of the T-shirt folding device of the invention.

Referring to the Drawings and in particular to FIG. 1, a shirt folding form 10 having an approximate square shape configuration, which incorporates two vertical folds 12, 14 and one horizontal fold 16, is shown. The form 10 is dimensioned such that each side 11, 13 of the square is approximately twenty-six inches in length; furthermore, the fold 16 divides the side 13 into two parts 13*a*, 13*b* which are twelve and fourteen inches, respectively, whereas, the folds 12 and 14 divide the side 11 into three parts 11*a*, 11*b* and 11*c* which are nine, eight and one-quarter, and nine inches in length, respectively. It should be understood that these dimensions are utilized in the preferred embodiment of the invention and they may be modified by those skilled in the art without departing from the principles set forth in this invention.

The form 10 is fabricated from a cardboard material and one of its outer layers is slit at the vertical and horizontal folds 12, 14, 16 in order to permit easy rotation of certain sections in accordance with the teachings set forth by the invention. Suitable plastic materials may also be utilized in the fabrication of form 10 without diminishing the performance of the invention.

Figure 2:
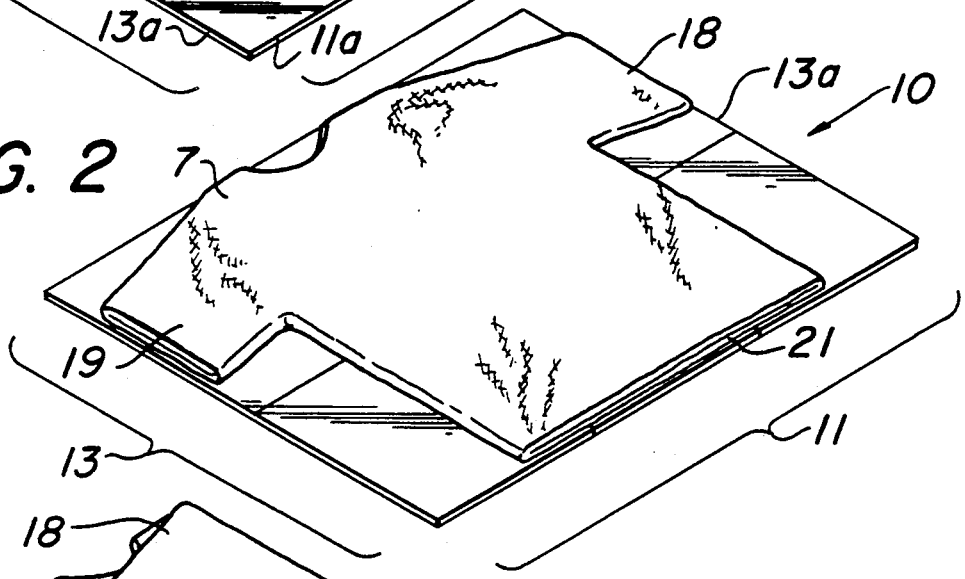
FIG. 2 illustrates the relationship of the device with respect to a T-shirt that is ready for folding.

FIG. 2 depicts the overall relationship of the form 10 with respect to a T-shirt 17 that is ready for folding. As can be readily understood the shirt 17 is laid upon the form 10 front side down by an operator so that the sleeves 18, 19 and waist extremity 21 are in approximate alignment with the respective edges 11, 13 and 13*a*. To facilitate the operation and to insure that an attractive folded shirt 7 results, the shirt is smoothly placed upon the form by the operator so that all major wrinkles are made to essentially disappear.

Figure 3:
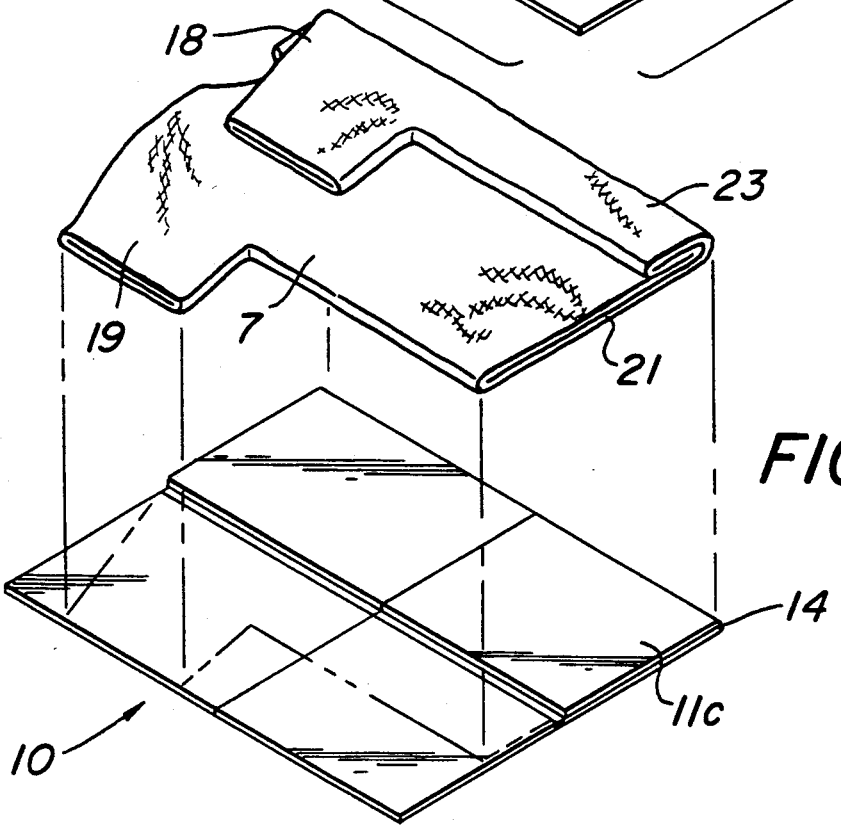
FIG. 3 shows a first step in the T-shirt folding method of the invention.

In FIG. 3 the first operational step of this embodiment of the invention is shown whereby the side 11*c* is grasped by the operator and rotated in a counterclockwise manner, as viewed from the waist 21 of the shirt, around the vertical fold 14. The resultant first fold in the shirt 7 is depicted above the form 10 where the right sleeve 18 and right side 23 are folded inwardly. FIG. 4 illustrates the condition of the T-shirt 7 after the first step of the folding operation has been completed and the vertical section 11*c* is rotated in a clockwise direction around the vertical fold 14. At this stage of the procedure, the form 10 is in its original status as shown in FIG. 2 except that the right side 23 of the shirt has been folded inwardly.

FIG. 5 represents the second step of the operation where the side 11*a* is rotated clockwise by the operator around the vertical fold 12. This causes the left side 25 of the shirt to fold in such a manner that the left sleeve 19 will lay upon the right sleeve 18 in the manner illustrated. By rotating the section 11*a* in a counterclockwise direction the form 10 is restored to its original flat orientation but the shirt 7 has now been partially folded as depicted in FIG. 6.

Figure 7:
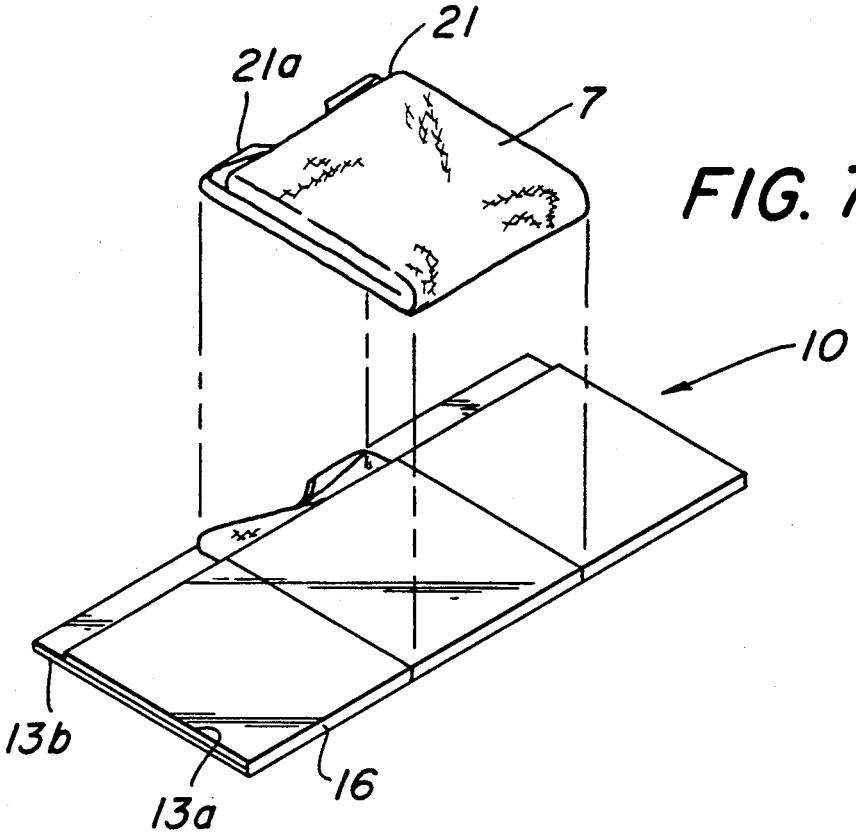
FIG. 7 illustrates the third step in the T-shirt folding method of the invention.
Figure 8:
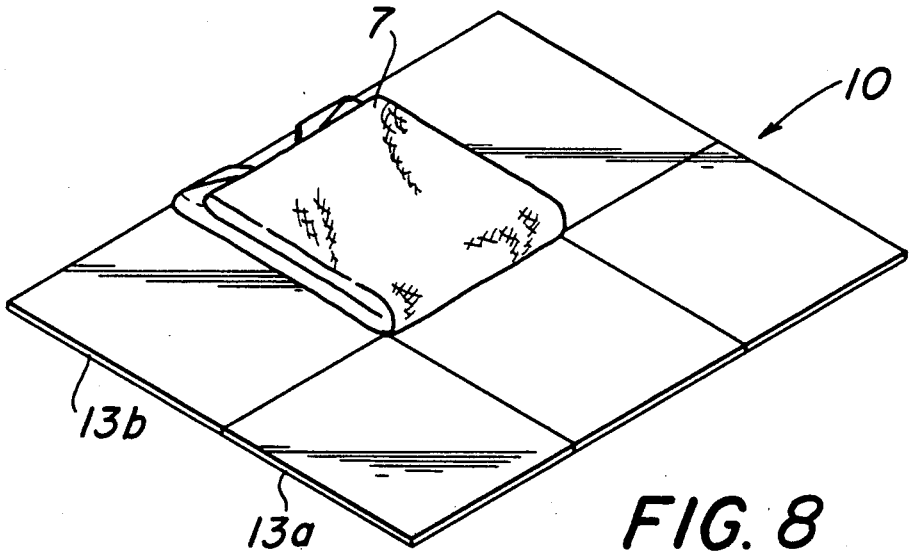
FIG. 8 depicts the state of the T-shirt after the third step has been completed and the folding device has been returned to its original state.
Figure 9:
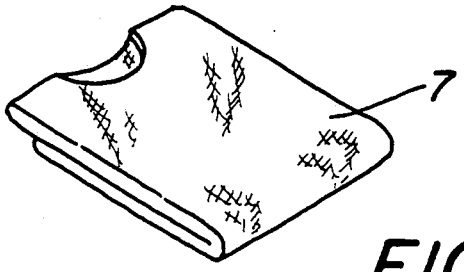
FIG. 9 shows the completed folded T-shirt.

The third step of the folding operation is illustrated in FIG. 7 where the shirt 7 is folded at its approximate mid-point by rotating side 13*a* in a counterclockwise manner as viewed from the left side of the drawing around the horizontal fold 16. Since 13*a* is slightly shorter in length than side 13*b* the form allows the waist or bottom edge 21 to be positioned below the shirt's top edge 21*a*. This feature allows easy grasping of the shirt 7 after the folding has been completed. FIG. 8 represents the status of the form 10 after the side 13*a* is returned to its original flat state. In FIG. 9, there is shown the completely folded shirt 7 after being turned front side-up from its downwardly facing position shown in FIG. 8, There has been above described an essentially three-step operation for folding a T-shirt 7 using a flat form 10 which incorporates three folds 12, 14 and 16. By proper placement of the shirt 7 upon the form, an operator can rapidly and efficiently achieve folding of the shirt 7 in only a few seconds. This is a significant achievement especially in the world of commerce such as in a manufacturing plant where T-shirts are fabricated after which they are folded and later boxed for shipment. In such an environment rapid folding is essential if the manufacturing is to be made into a commercial success.

The invention may also be readily applied to the folding of male dress shirts as illustrated in FIGS. 10–22. With reference to FIG. 10 a form 30 is shown having a plurality of folds consisting of two vertical folds 36, 38, two diagonal folds 32, 34 and one horizontal fold 40. The form 30 is also made of cardboard as ,a preferred material and one of its outer layers is slit at the folds 32, 34, 36 38 and 40 to allow ease of rotation during the folding procedure. In a preferred embodiment, the form 30 is dimensioned so that its width is approximately fifty inches and its height is approximately twenty-eight inches. The rectangular elements 44*a*, 44*b*, 44*c* and 44*d* which partially comprises the form 30 have height and width dimensions of approximately fourteen by twenty and one-half inches, respectively, where the width dimension crosses the diagonal lines 32, 34; and similarly, the height and width dimensions of rectangular elements 44*e* and 44*f* are fourteen by ten inches, respectively. The dimension along the base 43 of the triangle formed by, for example, the altitute 36 and hypothenuse or diagonal 32 is seventeen inches; furthermore, the length of the base 43*a* is similarly seventeen inches. The dimensions cited above may be varied in accordance with the skill of the art without departing from the essential elements which form the invention.

Referencing FIG. 11, a dress shirt 33 is placed upon the form 30 with the back of the shirt and arms facing in an upward direction, and the collar 33*a* being positioned beyond the edge 35 of rectangle 44*e*. Also, the sleeves of the shirt 33 are positioned outwardly until the cuff endings are respectively positioned beyond the edges of rectangles 44*a*, 44*c*. The front of the shirt 33 (not shown) is buttoned and in the manner previously described with respect to the T-shirt 7, the dress shirt is smooth so that it lays essentially flat upon the form 30.

The first step in the folding process for the dress shirt 33 is demonstrated in FIG. 12 where the form 30 is folded along the diagonal fold 34 by a counterclockwise rotation of the section including a portion of rectangles 44*c* and 44*d* as viewed from the side 42 or the width dimension of the form 30. The form 30 is returned to its original position in FIG. 13 after causing the sleeve 50 to be folded upon the back surface of shirt 33.

The identical procedure is followed in FIG. 14 for the second step of the operation where the form 30 is folded along fold 32 by a clockwise rotation of the section including a portion of rectangles 44*a*, 44*b*. The rotated section is returned to its original state so that form 30 is made flat as shown in FIG. 15 and the left arm 51 remains in a folded state behind the back of the shirt 33.

The third step of the shirt folding process is illustrated in FIG. 16 where the section of the form 30 which includes complete rectangles 44*c*, 44*d* is rotated counterclockwise along the fold 36. This step essentially narrows the width of the shirt 33 to make it suitable for packaging or storage, as the case may be, as seen in FIG. 17.

Step four of the shirt folding procedure is achieved in FIG. 18 and is accomplished by a clockwise rotation about the fold 38 by a section of the form 30 which includes the complete rectangles 44*a*, 44*b*. After the form 30 is returned to its original state as in FIG. 19 the left hand portion of the shirt 33 is folded to further reduce its width dimension.

The fifth folding step is as shown in FIG. 20 and results from a counterclockwise rotation of a section of form 30, as viewed in the left side of the drawing, about the fold 40 where the rotated section includes the rectangles 44*b*, 44*d* and 44*f*. The completely folded shirt 33 is depicted in FIG. 21 in a right side down position when the counter-rotated section is returned to its original state. FIG. 22 represents the completely folded shirt 33 in a right side up position and ready for packaging or storage as in a bureau or shelf, for example.

The embodiment of the invention illustrated in FIGS. 10–22 is particularly suitable for commercial use since an operator can fold a dress shirt in a period of time that is less than ten seconds. The folding procedure may be slightly longer when straight pins are used as in the practice when shirts are being retailed in a department store.

This invention has been described by reference to precise embodiments but it will be appreciated by those skilled in the art that this invention is subject to various modifications and to the extent that those modifications would be obvious to one of ordinary skill they are considered as being within the scope of the appended claims.

I claim:

1. A manually operated shirt folding device comprising:

(a) a flat and rectangular shaped member, (b) said member being dimensioned for receiving shirts upon its upper surface, (c) a plurality of creases formed in said member for folding portions thereof, (d) said folded portions allowing said shirts to be manually reduced in stages with said creases arranged in a horizontal, diagonal as well as in a vertical directions for facilitating the folding of said shirts and to achieve a uniform appearance.

2. The shirt folding device in accordance with claim 1 wherein said member is dimensioned to receive dress shirts.

3. The shirt folding device in accordance with claim 1 wherein said plurality of creases comprise two vertical and two diagonal creases and one horizontal crease.

4. The shirt folding device in accordance with claim 3 wherein said vertical creases are equally spaced on either side of an imaginary centerline parallel to a shortest edge of said device, said respective diagonal creases being spaced such that a first end intersects the topmost point of one said vertical crease, whereas, its second end is spaced from the bottom of said vertical crease, and said horizontal crease being positioned through the center of said device and perpendicular to said vertical creases.

5. A manually operated shirt folding device comprising:

(a) a flat and rectangular shaped member, (b) said member being dimensional for receiving a T-shirt upon its upper surface, (c) a plurality of creases formed in said member which are oriented in vertical and horizontal directions, (d) said vertical creases allowing said member to be manually folded to allow the sides of said shirt to be folded inwardly for reducing the width dimension of said shirt, (e) said horizontal creases allowing said member to be manually folded in half to reduce the vertical dimension of said shirt, (f) whereby said horizontal and vertical creases allow said member to uniformly package said T-shirt in a manually repetitive manner.

6. A manually operated shirt folding device comprising:

(a) a flat and rectangular shaped member, (b) said member being dimensioned for receiving a dress shirt upon its upper surface, (c) a plurality of creases formed in said member which are oriented in a vertical, horizontal and diagonal manner, (d) said diagonal creases allowing the members to fold the sleeves of said shirt upon the body portion of said shirt, (e) said vertical creases allowing said member to fold the sides of said shirt to reduce its width dimension after said sleeves have been folded, (f) said horizontal creases allowing said member to fold said shirt in half to reduce the vertical dimension of said shirt, and (g) whereby the horizontal, vertical and diagonal creases allow said member to uniformly package said dress shirt in a repetitive manner.

7. A shirt and folding apparatus combination for folding a shirt; said apparatus having a flat and rectangular shaped outline and including horizontal, vertical and diagonally shaped creases said shirt having:

(a) sleeves which are folded diagonally across its back surface;

(b) a body portion attached to said sleeves which is placed in a narrowed state by a turning in of sides of the shirt, and (c) said shirt including said folded sleeves and narrowed body portion further being folded in half for display or, alternatively, storage.

8. A method for folding a shirt for display or storage with an apparatus having foldable creases arranged in a horizontal, vertical and diagonal direction comprising the steps of:

(a) positioning said shirt with its front surface in a downward facing direction upon said apparatus with the center of said shirt being placed upon an imaginary centerline of said apparatus;

(b) consecutively folding said apparatus along said diagonal creases to fold the sleeves upon the back surface of said shirt;

(c) consecutively folding said apparatus along said vertical creases to narrow the width dimensions of said shirt;

(d) folding said apparatus along said horizontal crease to divide said shirt in half, and (e) whereby said shirt is in a condition for storage or, alternatively, display when removed from said apparatus and rotated with its front surface being oriented in an upward direction.

* * * * *